United States Patent [19]

Copas et al.

[11] Patent Number: 4,518,021

[45] Date of Patent: May 21, 1985

[54] MACHINE FOR FILLING CONTAINERS

[75] Inventors: Gordon A. Copas, Rockford; Howard C. Wilke, Belvidere; Dennis A. Dykema, Rockford, all of Ill.

[73] Assignee: APV Anderson Bros. Inc., Rockford, Ill.

[21] Appl. No.: 576,813

[22] Filed: Feb. 3, 1984

[51] Int. Cl.[3] ..... B65B 43/58

[52] U.S. Cl. ..... 141/172

[58] Field of Search ..... 141/165, 172, 191, 194, 141/263, 264, 269

[56] References Cited

U.S. PATENT DOCUMENTS

| | | | |
|---|---|---|---|
| 2,121,065 | 6/1938 | Anderson | 141/172 X |
| 2,612,016 | 9/1952 | Anderson | 53/518 |
| 2,614,740 | 10/1952 | Moser | 141/172 |
| 3,124,916 | 3/1964 | Anderson et al. | 53/471 |
| 3,172,434 | 3/1965 | Boucher | 141/59 |
| 3,364,651 | 1/1968 | Stohlquist | 53/266 R |
| 4,388,795 | 6/1983 | Stohlquist et al. | 53/435 |

*Primary Examiner*—Stephen Marcus
*Assistant Examiner*—Mark Thronson
*Attorney, Agent, or Firm*—Vernon J. Pillote

[57] ABSTRACT

A machine for filling containers with a viscous product to a preselected fill level below the top of the container. The filling machine has a downwardly opening nozzle and a valve for controlling the flow of product through the nozzle. An elevator mechanism is arranged to elevate an empty container into telescoping relation with the nozzle and then allow the container to move downwardly as it is filled. A mechanism senses when the container support platform moves downwardly to a position in which the discharge end of the nozzle is adjacent the desired fill level on the container, and an elevator drive mechanism is operated to positively move the container downwardly off the nozzle to a position substantially below the lower end of the nozzle to draw product in the container from the product in the nozzle. The product fill valve includes a valve piston that is movable downwardly toward the discharge outlet on the nozzle to an open position as the elevator raises a container to telescoping relation with the nozzle, and the valve piston is moved upwardly away from the discharge outlet on the nozzle to a closed position as the elevator mechanism moves the container downwardly off the nozzle.

7 Claims, 9 Drawing Figures

175
174
171
172
173
157
156
155
38
146
22
23
21
21a
111a
37
111
25
2
2
82
24
84
87
75
86
85
55
74
X
28
81
83
58
3
32
4
64
67
63
105
61
27
26
31
59
95
115
116
62
63
66
3
71
96
33
31
4
97
68
69
34

MACHINE FOR FILLING CONTAINERS

BACKGROUND OF THE INVENTION

Machines have heretofore been made for filling containers with a viscous product such as semi-solid confection materials in which the viscous product is discharged in a generally continuous fashion through a downwardly opening nozzle into the container, and the container, when filled, is moved crosswise of the nozzle to shear the product in the container from the product in the nozzle. Examples of such prior filling machines are shown in U.S. Pat. Nos. 2,612,016; 3,124,916; 3,172,434, 3,364,651 and 4,388,795. These prior filling machines utilized the container to measure the volume of product dispensed into each container, and used the upper edge of the container to shear off the material in the container from the material in the nozzle. Such prior apparatus, are only adapted for filling containers full to the top of the container. There are, however, some applications in which it is desired to fill a container with a volume substantially less than the full volume of the container, to provide a head space at the top of the container above the product level.

SUMMARY OF THE INVENTION

It is an object of the present invention to provide a machine for filling containers with a viscous product to a preselected fill level below the top of the container.

Another object of this invention is to provide a machine for filling containers in accordance with the foregoing object, and which vertically separates the product in the container from the product in the fill nozzle, after the container is filled to a preselected fill level below the top of the container.

Accordingly, the present invention provides a machine for filling containers with a viscous product to a preselected fill level below the top of the container and which comprises a downwardly extending nozzle at a filling station having a lower discharge end dimensioned to telescopically receive an upper portion of the container and a downwardly opening discharge outlet in the discharge end, with a valve means for controlling the flow of product from a product supply conduit to the discharge outlet. A container elevator means is provided at the filling station and includes a container support platform and a yoke spaced above the platform a distance sufficiently greater than the height of the container to allow a container to be moved horizontally into and out of fill position on the platform and below the yoke. An elevator drive means is operative to move the elevator means vertically from a lower elevator position in which the container support platform is spaced below the discharge end of the nozzle a distance substantially greater than the height of the container to a raised elevator position in which the container support platform is spaced below the lower discharge end of the nozzle a distance substantially less than the height of the container to raise a container on the platform into a partially telescoping relation with the nozzle. A sensing means senses when the container support platform moves downwardly as the container is filled from the raised elevator position to an intermediate elevator position in which the discharge end of the nozzle is adjacent the preselected fill level in the container. Means actuated by the sensing means operates the valve to a closed position shutting off delivery of product to the discharge outlet and operates the elevator drive means to move the elevator from the intermediate elevator position to the lower elevator position. The yoke member is constructed and arranged to engage the upper end of the container on the nozzle when the elevator is moved downwardly from its intermediate elevator position to thereby press the container downwardly off the nozzle. A container transfer means is operated in timed relation with the movement of the elevator means to its lower position to advance a filled container along a generally horizontal discharge path off the container support platform and to advance an empty container along a generally horizontal container infeed path onto the container support platform.

The valve is of a type having a valve piston mounted for sliding movement toward and away from the discharge outlet. The valve piston is moved toward the discharge outlet to an open position as the elevator moves toward its raised elevator position and the valve piston is moved away from the discharge outlet to a closed position as the elevator is moved toward the lower elevator position. Movement of the valve piston in a direction away from the discharge outlet tends to draw product away from the discharge outlet and aids in vertical separation of the product in the container from the product in the nozzle.

These, together with other objects and advantages of this invention will be more readily understood by reference to the following detailed description, when taken in connection with the accompanying drawings wherein.

Figure 1:
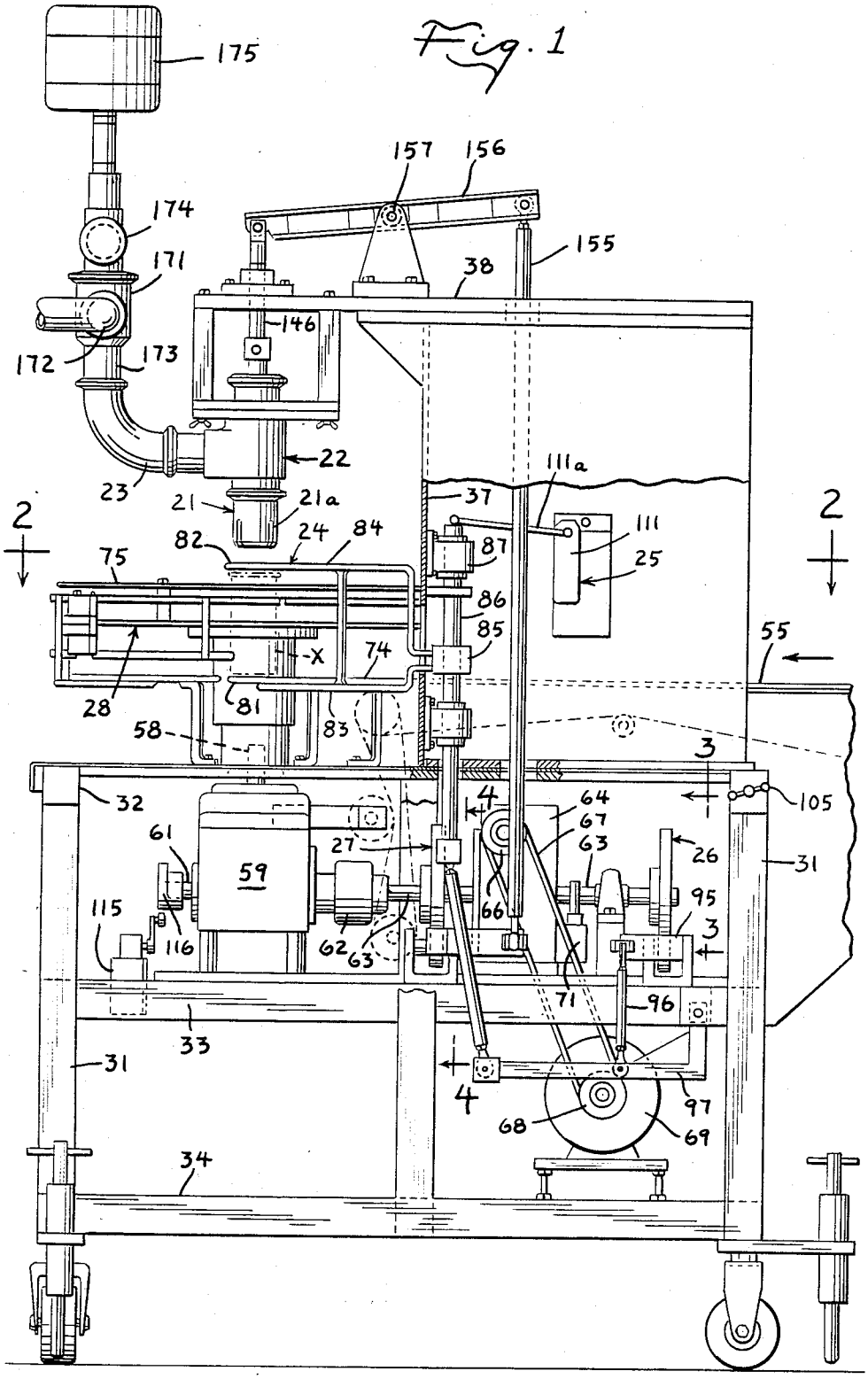
FIG. 1 is a front elevational view of a filling machine embodying the present invention.

The present invention relates to a machine for filling containers with a viscous product such as ice cream, sherbert and the like, to a preselected fill level below the top of the container. The filling machine in general includes a downwardly opening nozzle 21, a valve means 22 for controlling the flow of product from a product supply conduit 23 to the nozzle 21, a container elevator means 24 for elevating a container at the filling station into at least partial telescoping relation to the nozzle, container position sensing means 25 for sensing when the container on the nozzle moves downwardly to a preselected intermediate position in which the discharge end of the nozzle is adjacent the preselected fill level in the container. An elevator drive mechanism 26 is provided for operating the container elevator and a valve operating mechanism 27 is provided for operating the valve in timed relation with the container elevator mechanism. A container transfer mechanism 28 is arranged to advance a filled container away from the filling station and to advance a subsequent empty container to the filling station. A capping apparatus 29 is arranged to apply caps to the filled containers while they are advanced by the transfer mechanism 28.

The filling apparatus is mounted on a frame structure including a plurality of upright supports 31 and upper, intermediate and lower frame members 32, 33, and 34 that are connected to the upright frame members. A housing, having spaced side and end walls 36 and 37 extends upwardly adjacent the forward side of the machine and a support plate 38 is attached to the upper end of the housing and extends in cantilever fashion over the filling station. The product control valve 22 is attached to a plate 41 that is removably mounted as by wing nuts 42 on brackets 43 that extend downwardly from the projecting end of the support plate 38. The nozzle 21 is detachably secured as by a split V- clamp ring 44 to the product control valve 22, and extends downwardly therefrom.

The nozzle 21 has a cross-sectional configuration corresponding generally to the cross-sectional configuration of the upper portion of the container X to be filled, but is sufficiently smaller to allow the container to be moved into telescoping relation thereon. The lower end of the nozzle is tapered inwardly to facilitate guiding the container into telescoping relation with the nozzle and container guide ribs 21*a* (FIG. 1) are formed at circumferentially spaced locations around the nozzle to provide a small space between the outer surface of the nozzle and the walls of the container for the venting air from the container during filling. As shown, the nozzle 21 has a round cross-section for use in filling cylindrical containers of round cross-section. The nozzle defines a discharge outlet 21*b* at its lower end.

Figure 2:
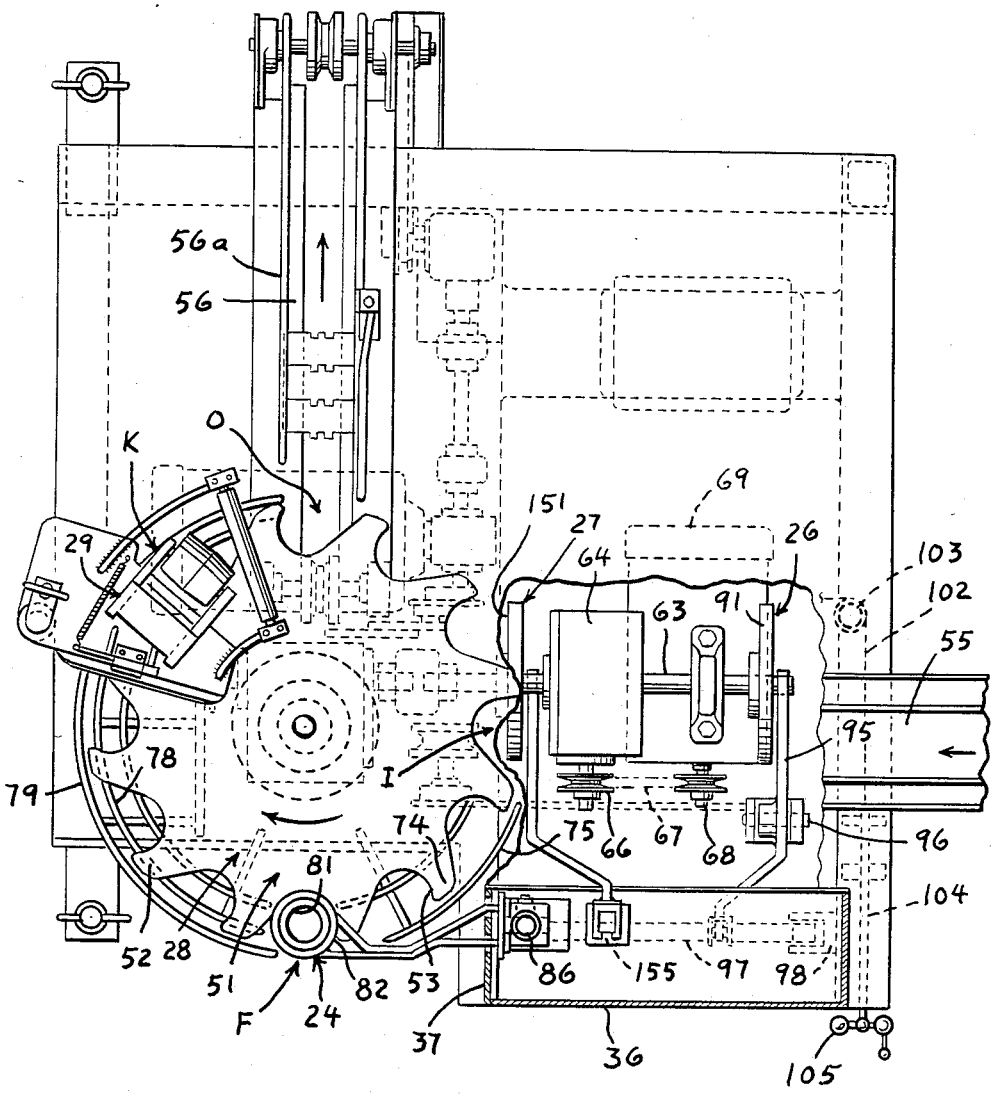
FIG. 2 is a fragmentary horizontal sectional view taken on the plane 2—2 of FIG. 1.

The container transfer mechanism 28 is herein shown in the form of a star wheel 51 having a plurality of outwardly extending arms 52 at angularly spaced locations therearound defining container receiving pockets 53 between adjacent arms. The container transfer mechanism is intermittently operated to advance containers from an inlet station I sequentially past the filling station F and the capping station K to the outlet station O. An inlet conveyor 55 is provided for feeding empty containers to the inlet station I and may, for example, be of the endless type which extends generally radially of the star wheel at the inlet station I. The inlet conveyor 55 is preferably driven in continuous fashion to advance empty containers into the star wheel pocket 53 at the infeed station I, and the infeed conveyor is formed with a sufficiently smooth surface to slip underneath the containers when the advance of the containers is interrupted by engagement with the star wheel. An outlet conveyor 56 extends generally radially of the star wheel at the outlet station O and is also conveniently driven in continuous fashion in the direction indicated by the arrow in FIG. 2, to move filled and capped containers away from the outlet station.

The star wheel is drivingly connected to the vertical output shaft 58 of a right angle index drive 59 having an input shaft 61 extending therethrough and which is operative, when the input shaft is rotated through one revolution, to dwell during a portion of that revolution and to index the star wheel a distance corresponding to the spacing or pitch of adjacent pockets on the star wheel, during another portion of the input shaft rotation. In the embodiment shown, the star wheel has twelve pockets and the right angle index drive 59 is arranged to angularly advance the star wheel in the direction indicated by the arrow in FIG. 2 through 30°, during a portion of each revolution of the input shaft 61. The input shaft 61 of the index drive 59 is connected through a coupling 62 to the output shaft 63 of a one revolution clutch 64. The input shaft 65 of the one revolution clutch is connected through a pulley 66, belt 67 and a pulley 68 to a drive motor 69. The one revolution clutch has an electrically operated actuator 71 (FIG. 1) which is operative, when actuated, to trip the clutch 64 and drive the output shaft 63 through one revolution.

The empty containers X are supported on container support rails 74 and guided by lateral guide rails 75 as they are advanced by the star wheel from the container infeed station I to the filling station F. The filled containers are supported on container support rails 78 and are guided by rails 79 as they are advanced by the star wheel from the filling station F, past the capping station K into the outlet station O. Container support rails 74 and 79 are spaced below the lower end of the nozzle a distance substantially greater than the height of the container. The container elevating mechanism 24 includes a container support platform 81 and a yoke member 82 that is spaced above the platform a distance sufficiently greater than the height of the container to allow a container to be moved horizontally into and out of a fill station on the platform and below the yoke member. In the embodiment shown, the platform 81 and yoke member 82 are respectively rigidly connected by laterally extending arms 83 and 84 to a block 85, and the block 85 is fixed to a shaft 86 that is slidably and non-rotatably supported for vertical movement in guides 87. The elevator mechanism is thus mounted for vertical movement between a lower elevator position in which the container support platform is spaced below the discharge end of the nozzle a distance substantially greater than the height of the container and a raised elevator position in which the container support platform is spaced below the lower discharge end of the nozzle a distance substantially less than the height of the container, to raise a container on the platform into at least partial telescoping relation with the nozzle. The yoke member is conveniently in the form of an annular ring dimensioned to move alongside the nozzle when the elevator is moved to its raised position.

Figure 3:
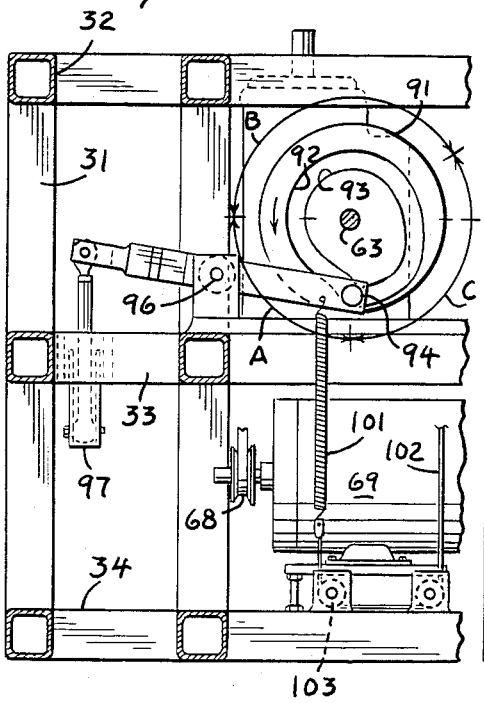
FIG. 3 is a fragmentary vertical sectional view taken on the plane 3—3 of FIG. 1.

As best shown in FIG. 3, the elevator drive mechanism 26 includes a cam 91 mounted on the output shaft 63 of the one revolution clutch 64, for rotation therewith. The cam 91 has outer and inner cam tracks designated 92 and 93 and which engage a cam follower 94. The follower 94 is operatively connected to the elevator mechanism to raise and lower the same and, in the embodiment shown, the follower 94 is rotatably mounted on one end of an arm 95 that is pivotally mounted intermediate its ends at 96 and which is connected at its other end through a link 96 to a lever 97. Lever 97 is pivotally mounted at one end on a pivot bracket 98 supported on the frame and is connected at its other end through a link 99 to the elevator shaft 86. In general, the outer cam track 92 is arranged to control the lower position of the elevator and the inner cam track 93 is arranged to control the upper position of the elevator. In addition, a means is provided for counterbalancing the elevator and the container and product thereon so that the container can move downwardly as it is filled under the weight and pressure on the product in the container. As shown in FIG. 3, a coil-type tension spring 101 has one end connected to the lever 95 adjacent the follower 94 and the other end connected through a cable 102 that is entrained over cable guide pulleys 103 and connected to an adjusting screw 104 (FIG. 2) operated by a crank 105. The spring is arranged to yieldably maintain the elevator in a raised position and, as shown, is connected to the lever 95 in a manner to urge the follower 94 toward the outer cam track 92. The adjusting screw 104 is manually adjustable by crank 105 to vary the tension on spring 101 in a manner to control downward movement of the container on the elevator in response to the weight and pressure on the product in the container. Since the nozzle 21 extends substantially completely across the upper end of the container when the container is telescoped thereon, the container moves downwardly on the nozzle by the product as it is filled.

The container position sensing means 25 is arranged to sense when the container support platform moves downwardly from its raised elevator position to an intermediate elevator position in which the discharge end of the nozzle is adjacent the desired fill level in the container. The container positioning sensing means comprises a switch 111 having an actuator 111*a* positioned to engage the elevator shaft 86. The switch 111 is arranged to be closed when the elevator mechanism 24 moves down to the intermediate elevator position at which the discharge end of the nozzle is adjacent the desired fill level in the container, and the switch 111 is electrically connected to the electrically operated actuator 71 for the one revolution clutch to operate the clutch when the switch 111 is closed. The switch 111 is preferably mounted for limited adjustment to control the position at which the elevator operates the switch. A normally closed cam switch 115 (FIG. 1) is connected in series with the elevator position sensing switch 111 and is operated from a cam 116 on the input shaft 61 of the index drive. Cam 116 allows the cam switch 115 to close when the shaft 63 is in its normal stop position shown in FIG. 3, and the cam is arranged to open the cam switch to prevent a repeat actuation of the clutch actuator 71 by the position sensing switch 111, until after the clutch has completed one revolution.

Figure 5:
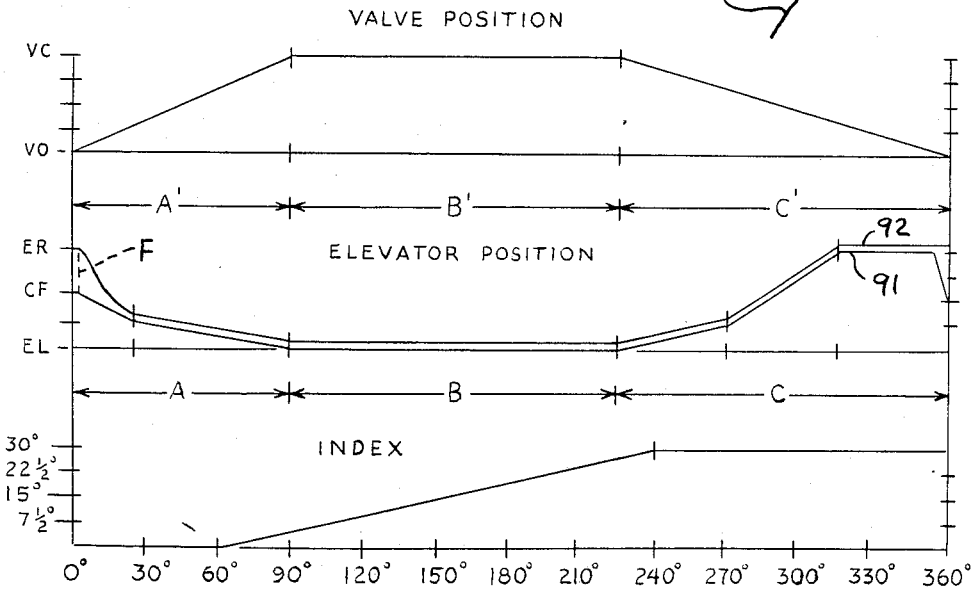
FIG. 5 is a timing diagram of the fill valve and container elevator.

The cam 91 is shown in FIG. 3 in its stop position and is arranged to be driven through one revolution in the direction indicated by the arrow in FIG. 3 by the one revolution clutch 64. As previousy described, the inner cam track 93 is shaped to control the lowermost position that the elevator can assume in different rotated positions of the cam and the outer cam track 92 is shaped to control the uppermost position that the elevator can assume in the different rotated positions of the cam. The graph of FIG. 5 illustrates the elevator position as controlled by the cams 92 and 93 on cam 91. When the cam is in its stop position shown in FIG. 3, the outer cam track 92 is arranged to engage the follower 94 only when the elevator platform is in its fully raised position shown in FIG. 8 and designated ER on the graph in FIG. 5. In the stop position of the cam, the inner cam track is spaced inwardly from the outer track a distance such that the follower 94 can move upwardly and allow the elevator platform to move downwardly to a position somewhat below the intermediate elevator position at which the elevator sensor 25 is operated. The inner and outer cam tracks are shaped in cam sector A to engage the cam follower 94 and move the elevator 24 downwardly to its lower elevator position designated EL in the graph of FIG. 5, to press the container down off the nozzle. The inner and outer cam tracks are shaped in cam sector B to engage the cam follower 94 and to hold the elevator in its lower elevator position. The inner and outer cam tracks are shaped in the sector C of the cam to engage the follower 94 and move the elevator to its raised elevator position and thereby move a container into telescoping relation with the nozzle. The inner cam track 93 falls away from the outer cam track 92 a short distance before the cam reaches its stop position, but the follower 94 remains in engagement with the outer cam track under the yieldable bias of tension spring 101 until the cam 91 rotates back to its stop position shown in FIG. 3. The index drive 59 is timed in relation to the operation of the cam 91, so as to index the star wheel and advance a filled container away from the fill station while advancing an empty container to the fill station, during the portion of the revolution of the clutch shaft in which the elevator mechanism 24 is in its lower elevator position.

The product control valve 22 includes a valve casing 125 defining a valve chamber 126 that extends therethrough and has the same internal diameter as the nozzle 21. The valve casing 125 has a flange at its lower end that cooperates with a corresponding flange on the upper end of the nozzle, and the flanges are clamped together by the aforementioned split V-shaped clamp ring 44. The valve casing 125 has a laterally extending passage 127 intermediate its ends defining a product inlet port 128 that intersects the chamber 126 intermediate the ends of the latter. A valve piston 131 is slidably mounted in the valve chamber and has a head 132 at one end and a sleeve portion 133 extending downwardly in the chamber and into the nozzle. The sleeve portion has an inlet port 134 below the head arranged to register with the casing port 128 when the valve member is in its lower position, and the sleeve portion extends downwardly through the valve chamber and into the nozzle to a location adjacent the nozzle discharge outlet 21*b*, when the valve piston is in its lower position. Seal rings 135 and 136 (FIG. 8) are provided on the valve piston to form a sliding seal with the valve casing and nozzle. The lower end of the sleeve is in open communication with the discharge outlet 21*b* in the nozzle, when the valve piston is in its lower or open position.

The valve is moved to a raised position away from the discharge outlet, to shut off flow through the product inlet port 134. A link 143 is connected to the upper end of the valve piston as by a pin 144 and it extends through the upper end of the valve casing and is connected as by a pin 145 to a rod 146 that is slidably and non-rotatably mounted in a guide 147 on the support plate 38.

The valve piston is moved to its open and closed position in timed relation with the movement of the elevator mechanism, with the valve piston being moved downwardly to an open position as the elevator is raised, and upwardly to a closed position as the elevator is lowered. The valve operating mechanism 27 includes a cam 151 mounted on the output shaft 63 of the one-revolution clutch for rotation therewith and having a cam track 152. A follower 153 engages the cam track and is mounted on one end of a lever 154 that is pivotally mounted at 154*a* intermediate its ends. The other end of the lever 154 is connected through a rod 155 to one end of a lever 156 that is pivotally mounted intermediate its ends at 157 and the other end of the lever 156 is connected as by a pin 158 to the valve operating rod 146.

Figure 4:
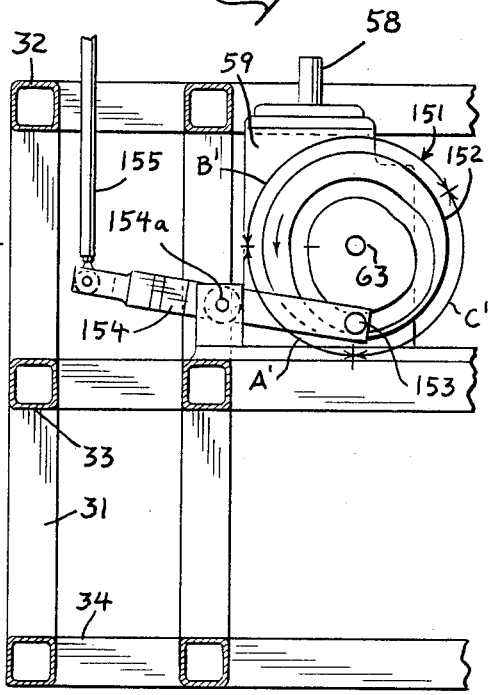
FIG. 4 is a fragmentary vertical sectional view taken on the plane 4—4 of FIG. 1.
Figure 6:
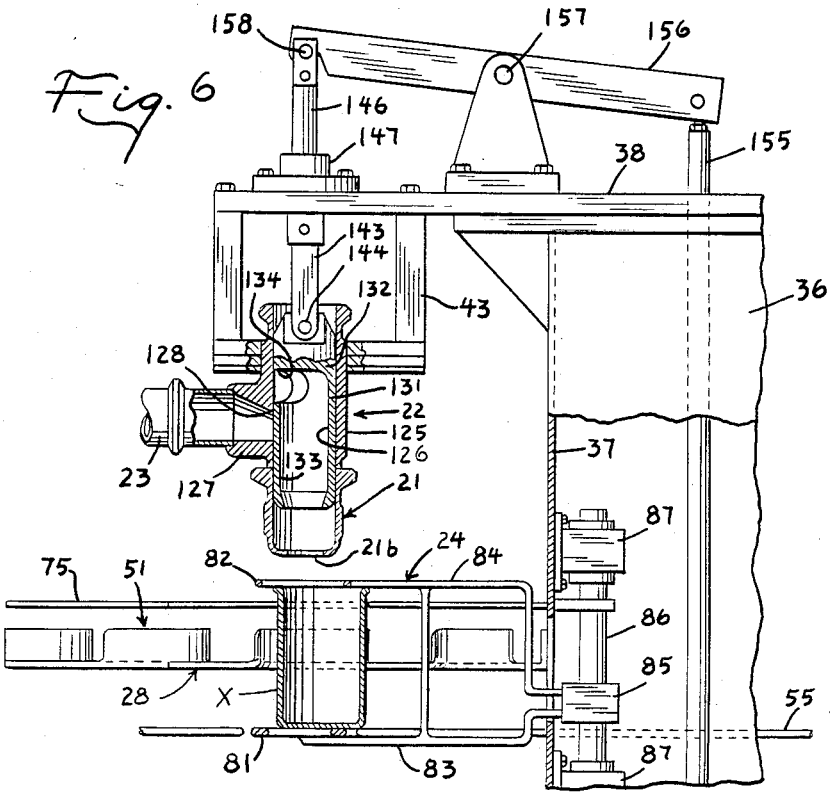
FIGS. 6, 7 and 8 are diagrammatic views illustrating different steps in the filling and shearing of material in the container from the material in the nozzle.
Figure 7:
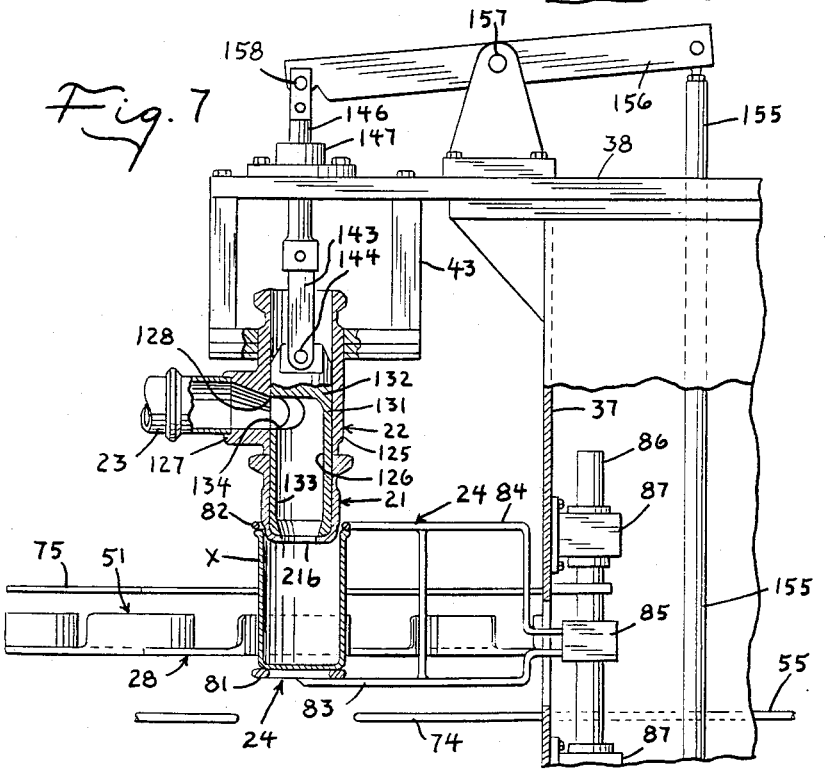
Figure 8:
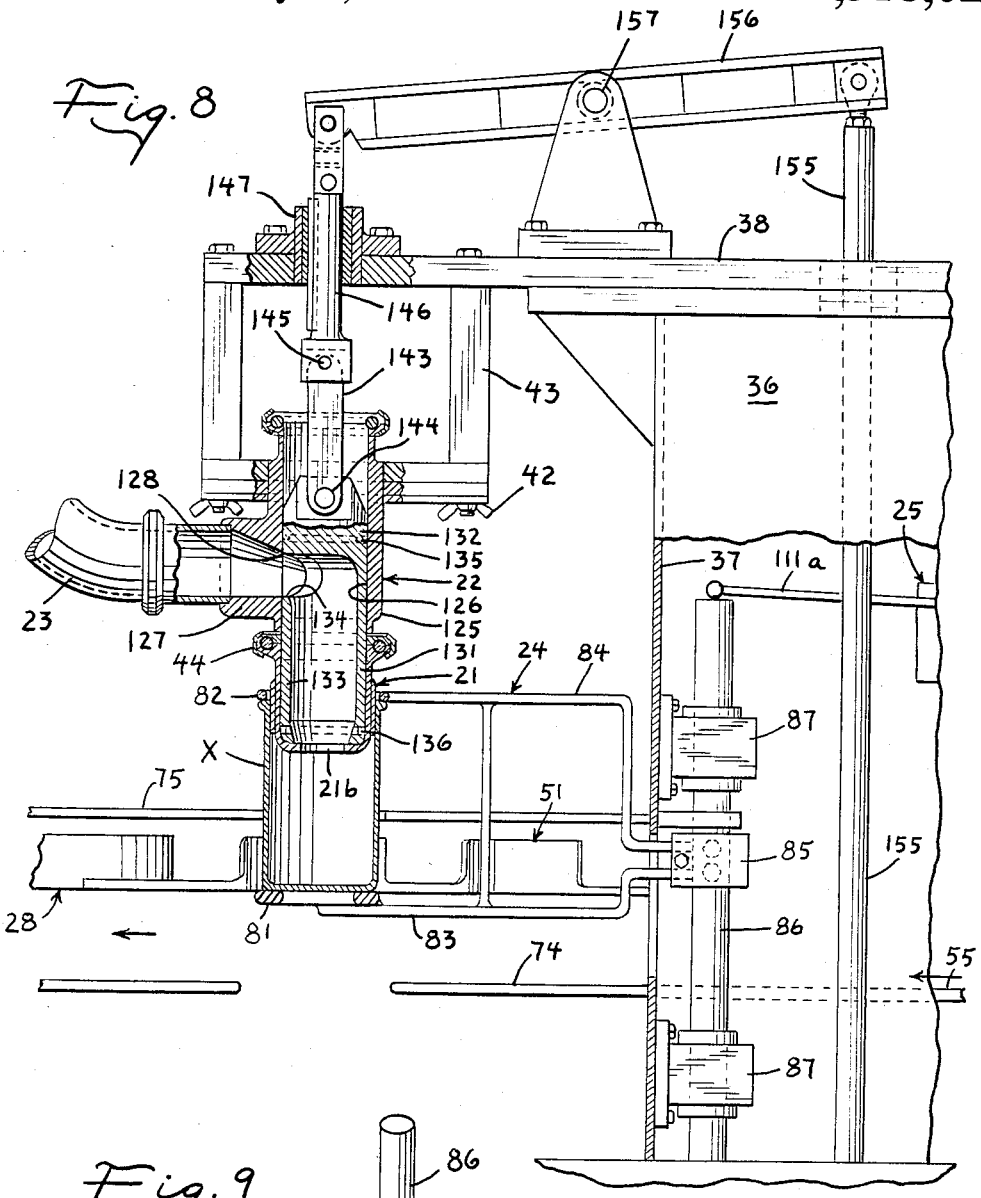
Figure 9:
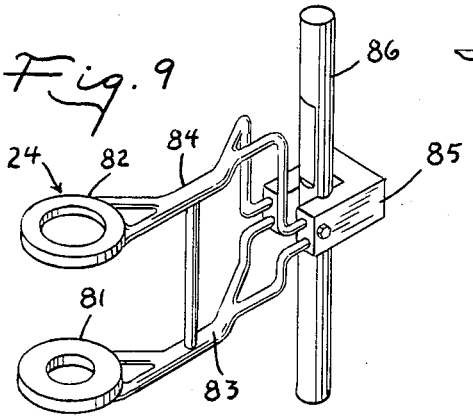
FIG. 9 is a perspective view of the container elevator.

The cam 151 is shown in its stop position in FIG. 4 and, in that position, the cam has moved the valve down to its lower or fully open position shown in FIG. 8 and designated VO in FIG. 5. As previously described, the elevator moves downwardly as the container is filled and, when the elevator reaches a preselected intermediate position such as shown in FIG. 7 and designated CF in FIG. 5, the elevator position sensing means 25 operates the one revolution clutch that drives shaft 63 through one revolution. As the cam 151 is rotated in the direction indicated by the arrow in FIG. 4 from the stop position, the cam track 152 in cam sector A' engages the follower 153 and moves the valve upwardly away from the discharge outlet to a fully closed position, as shown in FIG. 6 and designated VC in FIG. 5. The cam track 152 maintains the valve in a fully closed position as sector B' of the cam rotates past the follower and the cam track thereafter moves the valve piston downwardly back to its open position as cam sector C' moves past the cam follower. Thus, as graphically shown in FIG. 5, when the cam completes one revolution and comes to its stop position, the valve is in its lower fully open position VO and the elevator is in its raised position designated ER. The cam tracks 92 and 93 are spaced apart when the cam 91 is in its stop position so that the follower 94 can move upwardly and the elevator can move downwardly as shown by the broken line F in FIG. 5, against the bias of the spring 101 as the container is filled by the nozzle. When the elevator moves down to a preselected fill position shown in FIG. 7 and designated CF in FIG. 5 in which the upper edge of the container is spaced a preselected distance above the lower edge of the nozzle, the sensor 25 operates the one revolution clutch to rotate shaft 27 through one revolution. Elevator cam 91 then moves the elevator down to its lower elevator position designated EL in FIG. 5 as it rotates through sector A to position B and the valve operating cam simultaneously moves the valve from its lower fully open position VO upwardly to its fully closed position VC as the cam rotates through sector A'. The elevator cam 91 is arranged to maintain the elevator in its lower position and the valve operating cam 151 is arranged to maintain the valve in its upper or closed position as it rotates through cam sector B'. As the cams 91 and 151 rotate through sectors B and B' respectively, the index drive 59 operates to advance a filled container off the elevator platform and to advance a succeeding empty container onto the platform. Elevator cam 91 is then arranged to rapidly raise the elevator mechanism to move a container into telescoping relation with the nozzle as it rotates through sector C and the valve cam 151 is arranged to move the valve downwardly to its open position as it rotates through sector C'.

With the above-described arrangement, the container moves downwardly on the nozzle as it is filled against the bias of the spring 101 until it reaches a position as shown in FIG. 7 in which the lower end of the nozzle is adjacent the desired fill level in the container. The container is then rapidly moved downwardly by the yoke 11 off the nozzle and to a position spaced below the nozzle as shown in FIG. 1. This tends to draw the product in the container away from the product in the nozzle, to vertically separate the same. In addition, during the time the container is moved downwardly off the nozzle by the elevator, the valve piston is moved upwardly. This not only shuts off the flow of product to the valve nozzle, but also tends to draw the product that is in the nozzle away from the discharge outlet due to the upward movement of the valve piston. This further enhances separation of the product in the nozzle from the product in the container. When a subsequent empty container is elevated into a position in telescoping relation with the nozzle as shown in FIG. 8, the valve piston is moved downwardly and this not only opens the valve but also pushes the product in the nozzle below the valve piston outwardly through the discharge outlet to increase the rate of flow of product during the initial fill of the container.

Provision is made for interrupting the supply of product to the filling machine prior to start-up of the filling machine and also in the absence of a container in filling position. As shown in FIG. 1, a diverter valve 171 is provided in the product supply conduit 23. The diverter valve has a product inlet 172, a product outlet 173 and a bypass outlet 174. The diverter valve is arranged to normally pass product from the inlet 172 to the outlet 173 and has an actuator 175 which is selectively operable to move the valve to a bypass position, bypassing product from the inlet 172 to the bypass outlet 174. Any suitable means such as a manually operable switch and a container sensing switch (not shown) can be utilized to control operation of the valve actuator 175.

The embodiments of the invention in which an exclusive property or privilege is claimed are defined as follows:

1. A machine for filling containers with a viscous product to a preselected fill level below the top of the container comprising, a downwardly extending nozzle at a filling station having a lower discharge end dimensioned to telescopically receive an upper portion of the container and a downwardly opening discharge outlet in the lower discharge end, a product supply conduit, valve means for controlling flow of product from the supply conduit to the discharge outlet, container elevator means at the filling station including a container support platform and a yoke member spaced above the platform a distance sufficiently greater than the height of the container to allow a container to be moved horizontally into and out of a fill position on the platform and below the yoke member, elevator drive means for moving the elevator means vertically from a lower elevator position in which the container support platform is spaced below the discharge end of the nozzle a distance substantially greater than the height of the container to a raised elevator position in which the container support platform is spaced below the lower discharge end of the nozzle a distance substantially less than the height of the container to raise a container on the platform into at least partial telescoping relation with the nozzle, the yoke member having a downwardly facing container engaging surface arranged to engage the upper edge of a container when the yoke member is moved downwardly, the yoke member in the lower elevator position having said container engaging surface positioned below the lower discharge end of the nozzle and the yoke member being constructed and arranged to move alongside the nozzle when moved to the raised elevator position, means operated in timed relation with movement of the container support platform to its raised elevator position for operating the valve means to an open position to deliver product to the discharge outlet, means yieldably opposing downward movement of the container support platform from its raised elevator position toward its lower elevator position to allow the container on the platform to move downwardly under the weight and pressure of the product entering the container from the discharge nozzle, means for sensing when the container support platform moves downwardly from the raised elevator position to an intermediate elevator position in which the discharge end of the nozzle is adjacent said preselected fill level in the container, means actuated by said sensing means when the container support platform moves down to said intermediate elevator position for operating said valve means to a closed position shutting-off delivery of product to the discharge outlet and for operating said elevator drive means to positively move said elevator means from said intermediate elevator position to said lower elevator position, said yoke member being constructed and arranged to engage the upper end of the container on the nozzle when the elevator is moved downwardly from said intermediate position to move the container downwardly off the nozzle, container transfer means operated in timed relation with movement of the elevator means to its lower position to advance a filled container along a generally horizontal filled container discharge path off the container support platform and to advance an empty container along a generally horizontal container infeed path onto the container support platform.

2. A machine for filling containers according to claim 1 wherein said valve means includes a valve piston mounted for sliding movement toward and away from the discharge outlet on the nozzle, said means for operating said valve means being operative to move the valve piston toward the discharge outlet to an open position as the elevator means is moved toward said raised elevator position and to move the valve piston away from the discharge outlet to a closed position as the elevator means is moved toward said lower elevator position.

3. A machine for filling containers according to claim 1 wherein said valve means includes a stationary valve casing defining a vertically elongated valve chamber in open communication with the upper end of the nozzle and having a casing inlet port communicating with the product supply conduit, a valve piston slidable vertically in the valve chamber toward and away from the discharge outlet, said means for operating the valve means being operative to move the valve piston downwardly toward the discharge outlet to an open position as the elevator drive means moves the elevator means toward its raised elevator position and to move the valve piston upwardly away from the discharge outlet to a closed position as the elevator drive means moves the elevator means toward its lower elevator position.

4. A machine for filling containers according to claim 3 wherein said valve piston has a sleeve portion extending downwardly in the nozzle to a level adjacent the discharge outlet when the valve piston is moved downwardly to its open position.

5. A machine for filling containers according to claim 1 wherein said valve means includes a stationary valve casing defining a vertically elongated valve chamber in open communication with the upper end of the nozzle and having a lateral casing inlet port communicating with the supply conduit, a valve piston slidable vertically in the valve chamber toward and away from the discharge outlet, the valve piston having a lateral valve inlet adapted to register with the casing inlet when the valve piston is in a lower valve position and a sleeve extending downwardly in the nozzle to a level adjacent the discharge outlet when the valve piston is in said lower valve position, said means for operating the valve means being operative to move the valve piston downwardly toward said lower valve position as the elevator drive means moves the elevator means toward its raised elevator position and to move the valve piston upwardly away from the discharge outlet as the elevator drive means moves the elevator means toward its lower elevator position.

6. A machine for filling containers according to claim 1 wherein said yoke member is in the form of an annular ring having an internal opening sufficiently larger than the discharge end of the nozzle to telescopically receive the same.

7. A machine for filling containers according to claim 1 wherein the transfer means includes a plurality of container pusher members mounted for movement along a horizontal path at a level intermediate said container support platform and the yoke member.

* * * * *